US006378512B1

(12) United States Patent
Staggemeier

(10) Patent No.: US 6,378,512 B1
(45) Date of Patent: Apr. 30, 2002

(54) DISCHARGE NITROUS OXIDE AND FUEL INJECTION PLATE

(75) Inventor: Karl Staggemeier, Huntington Beach, CA (US)

(73) Assignee: Holley Performance Products, Inc, Bowling Green, KY (US)

( * ) Notice: Subject to any disclaimer, the term of this patent is extended or adjusted under 35 U.S.C. 154(b) by 0 days.

(21) Appl. No.: 09/703,728

(22) Filed: Nov. 2, 2000

Related U.S. Application Data

(60) Provisional application No. 60/163,081, filed on Nov. 2, 1999.

(51) Int. Cl.[7] ..... F02B 23/00

(52) U.S. Cl. ..... 123/585; 261/118

(58) Field of Search ..... 123/585; 261/118

(56) References Cited

U.S. PATENT DOCUMENTS 5,839,418 A 11/1998 Grant ..... 123/585

*Primary Examiner*—Noah P. Kamen
(74) *Attorney, Agent, or Firm*—Hunton & Williams

(57) ABSTRACT

Anoxidizer and fuel plate is disclosed which discharges nitrous oxide and fuel into an intake manifold.The plated between a carburetor and an intake manifold and it provides a construction which slow the flow of the nitrous oxide so that the nitrous oxide introduced into the airstream is substantially uniformly distributed.

26 Claims, 14 Drawing Sheets

DISCHARGE NITROUS OXIDE AND FUEL INJECTION PLATE

CROSS-REFERENCE TO RELATED APPLICATIONS

This application claims priority from a provisional U.S. patent application, Ser. No. 60/163,081, filed Nov. 2, 1999, the entire contents of which are incorporated herein by reference in a manner consistent with this application.

FIELD OF THE INVENTION

This invention is directed to a module placed between the carburetor and the intake manifold of an internal combustion engine for adding fuel and nitrous oxide to the airstream flowing from the carburetor to the engine.

BACKGROUND OF THE INVENTION

Nitrous oxide is a preferred oxidizer used to boost horsepower in high performance internal combustion engines. Nitrous oxide as an oxidizer is typically used in racing applications. However, in order to efficiently harness the energy provided by the nitrous oxide, the nitrous oxide should ideally be as evenly distributed as possible to the various cylinders of the engine. Nitrous plates having criss-crossing nitrous oxide and fuel feed tubes have been proposed for this purpose. For instance, U.S. Pat. No. 5,839,418 is directed to a dual stage nitrous oxide and fuel injection plate having two pairs of nitrous oxide and fuel feed tubes. Each pair comprises a nitrous oxide tube and a fuel feed tube, the tubes being parallel to each other. One pair of tubes is perpendicular to the other pair. A first pair of parallel tubes is provided upstream with respect to a second pair of parallel tubes. In each pair of parallel tubes, the upstream tube is supplied with nitrous oxide, whereas the downstream tube is supplied with fuel. A plurality of spray ports are provided along the length of each tube. By having one pair of parallel tubes angled perpendicular with respect to another pair, the '418 Patent attempts to create a homogeneous mixture of fuel and nitrous oxide. But the plate (or module) configuration of the '418 Patent fails to do so. This is principally due to the pressure under which the nitrous oxide is supplied.

The '418 Patent notes that the nitrous oxide is supplied in liquid form, typically on the order of 1000 psi. The nitrous oxide supply tubes in the respective tube pairs, i.e., the upper tubes in the '418 Patent in each tube pair, each have an inlet supply port. The nitrous oxide is supplied to the tubes through the inlet supply ports under extremely high pressure. The spray ports are extremely small, on the order of the size of a pin hole. A pressure gradient is developed along the length of and within the nitrous oxide supply tubes. Namely, the pressure is highest within the tubes further from the supply ports. This is because the nitrous oxide"dams" against the terminal walls of the nitrous oxide supply tubes. Consequently, the higher pressure towards the terminal ends of the nitrous oxide supply tubes causes relatively more nitrous oxide to be delivered through the spray ports farthest from the inlet supply ports. Thus, an uneven distribution of nitrous oxide is introduced into the airstream. This, in turn, leads to different levels of nitrous oxide being supplied to different cylinders.

Therefore, there is a need for a nitrous oxide and fuel injection module which supplies a substantially uniform distribution of nitrous oxide to all of the engine's cylinders. These and other disadvantages of the prior art are overcome by the nitrous oxide and fuel injection plate of the present invention.

SUMMARY OF THE INVENTION

It is an object of the present invention to provide a nitrous oxide and fuel injection plate or module providing a substantially uniform distribution of nitrous oxide and fuel to the airstream passing through the plate.

It is a further object of the present invention to provide a nitrous oxide and fuel injection plate or module which has one or more airstreams flowing therethrough.

These and other objects of the preferred embodiments are provided by a fuel supply module (also referred to herein as a"module") for adding fuel and nitrous oxide to an airstream flowing from a carburetor to the intake manifold of an internal combustion engine, comprising:

- a plate member (also referred to herein as a"plate") for placement between the carburetor and the intake manifold to an internal combustion engine, said plate member defining an air passage (or opening) therethrough sized and shaped for passing the airstream from a carburetor to an internal combustion engine, said air passage including a central axis extending parallel to the direction of flow of the gas, including the airstream, moving through said opening;
- at least one inlet feed port formed in said plate member for introducing nitrous oxide into said plate member;
- at least one inlet feed port formed in said plate member for introducing fuel into said plate member;
- a first communication passage formed in said plate member for distributing said nitrous oxide within said plate member;
- a second communication passage formed in said plate member for distributing said fuel within said plate member;
- at least one first discharge port formed in said plate member for discharging said nitrous oxide into said airstream, said at least one first discharge port causing said nitrous oxide to be discharged substantially evenly around the periphery of the air passage formed in said plate member; and
- at least one second discharge port formed in said plate member for discharging said fuel into said airstream, said at least one second discharge port causing said fuel to be discharged substantially evenly around the periphery of the air passage formed in the plate member.

The invention is also directed to an internal combustion engine comprising a fuel supply module for adding fuel and nitrous oxide to an airstream flowing from a carburetor to an intake manifold of the internal combustion engine. The internal combustion engine comprises:

- a plate member for placement (or placed) between a carburetor and an intake manifold of the internal combustion engine, said plate member defining an air passage through it sized and shaped for passing an airstream from the carburetor to the internal combustion engine, said air passage including a central axis extending parallel to the direction of flow of the airstream moving through the air passage;
- at least one inlet feed port formed in the plate member for introducing nitrous oxide into the plate member;
- at least one inlet feed port formed in the plate member for introducing fuel into the plate member;
- a first communication passage formed in the plate member for distributing the nitrous oxide within said plate member;

a second communication passage formed in the plate member for distributing the fuel within the plate member;

at least one first discharge port formed in the plate member for discharging the nitrous oxide into the airstream, said at least one first discharge port causing the nitrous oxide to be discharged substantially evenly around the periphery of the air passage formed in the plate member; and at least one second discharge port formed in the plate member for discharging the fuel into the airstream, said at least one second discharge port causing the fuel to be discharged substantially evenly around the periphery of the air passage formed in the plate member.

Other objects, features and advantages of the preferred embodiments will become apparent to those skilled in the art when the detailed description of the preferred embodiments is read in conjunction with the drawing figures.

BRIEF DESCRIPTION OF THE DRAWING FIGURES

DETAILED DESCRIPTION OF THE PREFERRED EMBODIMENTS

Figure 2B:
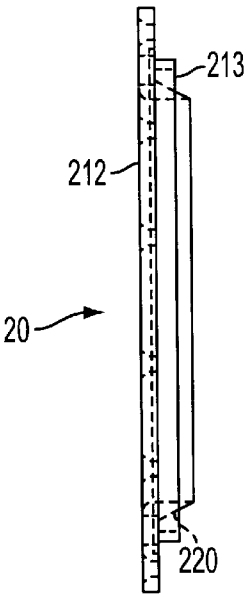
FIG. 2B is a side view of the top plate member of FIG. 1.

The present invention is directed to an improved module 10 for delivering a homogeneous supply of nitrous oxide and fuel into the engine's intake manifold. The module 10 is situated between the carburetor and the intake manifold. Three preferred embodiments of the module are disclosed. Each module comprises a plate, which may be conveniently described with reference to three principal components, namely, a top plate member 20, a bottom plate member 40 and a body plate member 30 positioned between the top and bottom plate members.

Referring now to FIGS. 1–12, the plate (also referred to herein as an "annular discharge nitrous oxide and fuel injection plate" or "module" or "annular discharge plate") 10 according to the first preferred embodiment is illustrated. The annular discharge plate 10 comprises three main components, namely a top plate member 20 FIGS. 1–3), a body plate member 30 (FIGS. 4–9), and a bottom plate member 40 FIGS. 10–12). The top plate member 20 and bottom plate member 40 sandwich the body plate member (or "body member") 30, forming the completed annular discharge plate 10. Within each of the plate members 20, 30, 40 are subcomponents which are described below.

Figure 1:
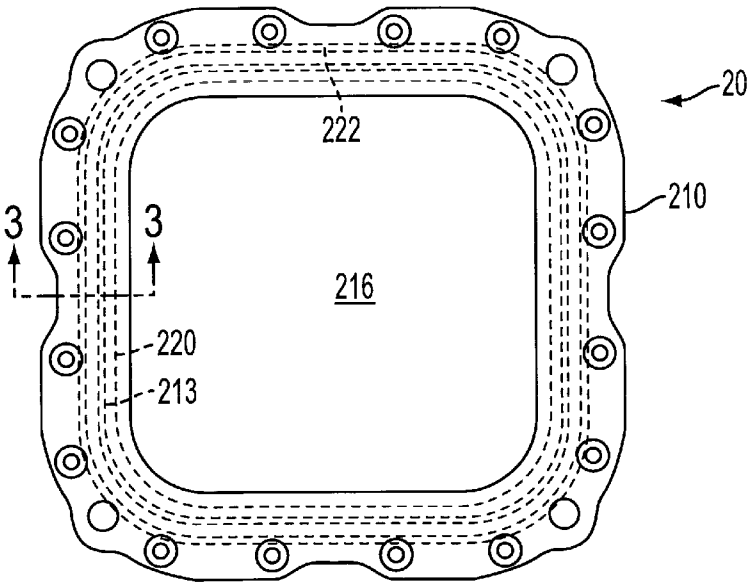
FIG. 1 is a top plan view of the surface of the top plate member, which member faces the body plate member according to a first preferred embodiment of the module.
Figure 2A:
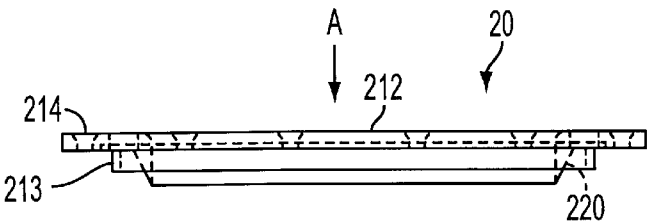
FIG. 2A is a side view of the top plate member of FIG. 1.
Figure 3:
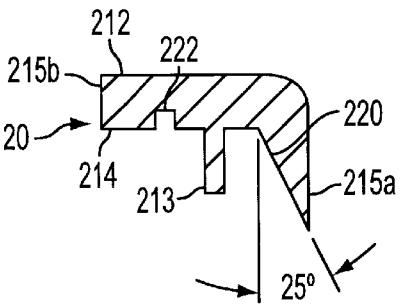
FIG. 3 is a cross sectional view taken along line 3—3 in FIG. 1.

With particular reference to FIGS. 1–3, the top plate member 20 comprises a top plate 210 having a top surface 212 which comes into contact with the carburetor. The top plate member 20 includes a central portion 216 through which an airstream A flows, as shown representatively in FIG. 2A. A wall (also referred to herein as a "fence") 213 protrudes from the bottom surface 214 of the top plate member 20 inwardly of the side edges 215*a*, 215*b* thereof. The wall 213 cooperates with the body member 30 to form a restriction in the nitrous oxide feed path to slow the flow of the nitrous oxide and allow it to be distributed substantially evenly around the central portion 216 prior to the delivery into the airstream A. The wall 213 extends around the perimeter of central portion 216. The inner side edge 215*a* of the top plate member 20 is defined by a conical surface 220. Conical surface 220 cooperatively engages a corresponding conical surface 320 (FIG. 9) formed on the inner side edge of the body plate member 30. A channel 222 is provided adjacent the wall 213. A gasket is positioned within channel 222 to contain the nitrous oxide within the module.

Turning now to FIGS. 4–9, the details of the body plate member 30 are illustrated. The body plate member 30 comprises a body plate 310 having a top surface 312 which comes into contact with the bottom surface 214 of the top plate member 20. The body plate member 310 has a bottom surface 314. The body plate member 30 includes a central portion 316 through which the airstream A flows, as shown representatively in FIG. 7. A nitrous oxide channel 318 is formed in the top surface 312. When the module is assembled, the wall or fence 213 is positioned substantially centrally in the channel 318 to divide it into an outer reservoir and an inner reservoir (as discussed below). The inner side edge 315*a* of the body plate member 30 is defined by a conical surface 320. Conical surface 320 is inclined at a 25 degree angle. Conical surfaces 220, 320 cooperatively engage one another upon assembly of the module 10.

The body plate member 30 includes a plurality of nitrous oxide inlet feed ports 330 and fuel inlet feed ports 340 formed therearound. The nitrous oxide and fuel inlet feed ports may be threaded. The fuel supply module comprises a first communication passage for distributing nitrous oxide within the plate member. The fuel supply module also comprises a second communication passage for distributing fuel within the plate member. 30 The first and second communication passages may have any suitable construction which enables them to perform their respective functions. In one embodiment, the first communication passage includes at least one nitrous oxide feed port 330 in fluid communication with at least one communication feed path 332. The at least one communication feed path 332 is in fluid communication with the channel (or "reservoir") 318, which surrounds the air passage. Each of the nitrous oxide feed ports 330 is in fluid communication with at least one communication feed path 332. The first communication passage also includes the wall or a fence 213 (FIG. 3) which (when the module is assembled) subdivides the nitrous oxide channel 318 into an inner reservoir (closest to the center of the central portion 316) and an outer reservoir.

Figure 7:
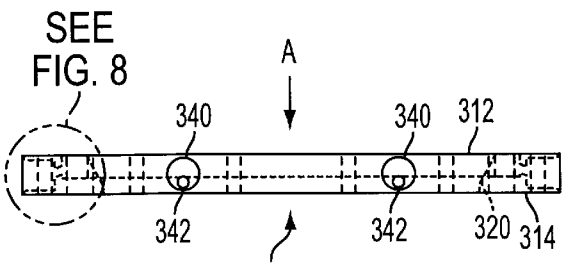
FIG. 7 is a side view of the body plate member of FIG. 4.
Figure 9:
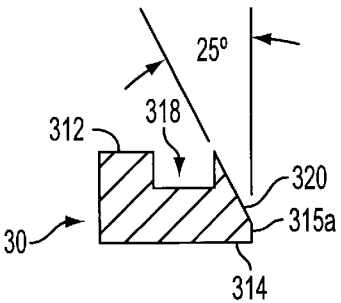
FIG. 9 is a cross sectional view taken along line 9—9 in FIG. 4.
Figure 8:
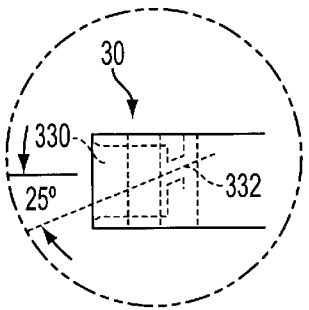
FIG. 8 is a detail view taken from FIG. 7.
Figure 12:
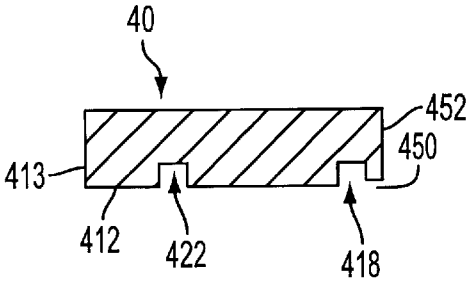
FIG. 12 is a cross sectional view taken along line 12—12 in FIG. 10.
Figure 14B:
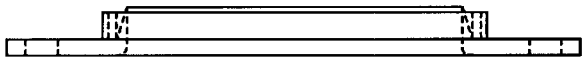
FIG. 14B is a side view of the top plate member of FIG. 13.
Figure 13:
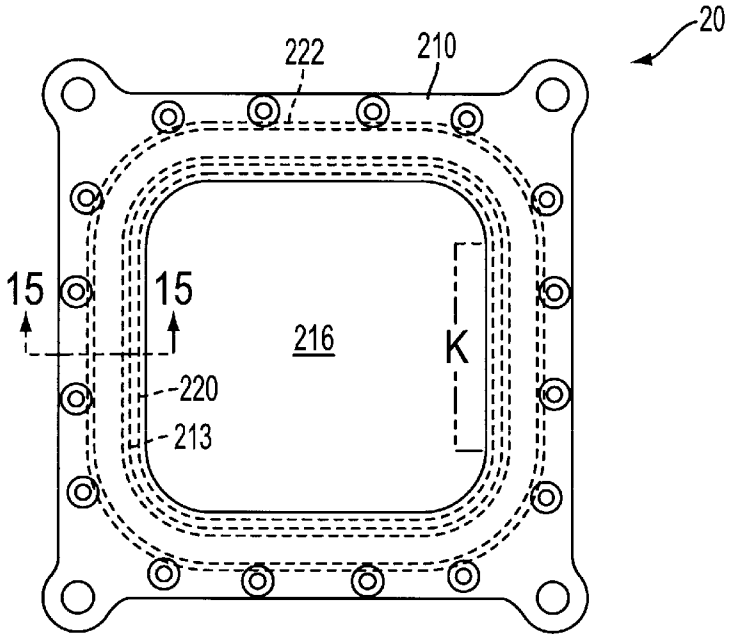
FIG. 13 is a top plan view of the top plate member according to a second preferred embodiment of the module.
Figure 14A:
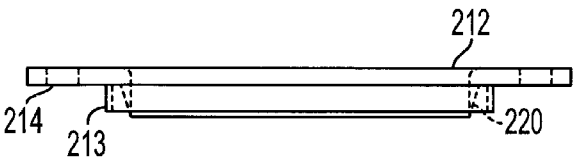
FIG. 14A is a side view of the top plate member of FIG. 13
Figure 15:
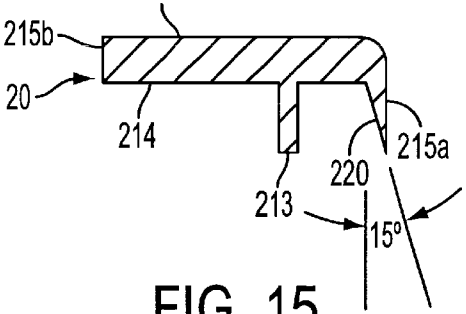
FIG. 15 is a cross sectional view taken along line 15—15 in FIG. 13.

In one embodiment, the second communication passage comprises at least one fuel inlet feed port 340 in fluid communication with at least one communication feed path 342 (FIG. 7). The at least one communication feed path 342 is in fluid communication with a fuel channel (or fuel reservoir) 418 (FIG. 12) formed in the bottom plate member 40. The second communication passage also comprises at least one discharge port 450 in fluid communication via a communication feed path 342 with a fuel channel 418. Thus, the nitrous oxide feed ports 330 are in fluid communication via one or more communication feed paths 332 with a channel 318 (FIG. 8). The fuel feed ports are in fluid communication via a communication feed path 342 with the channel 418 (FIGS. 7 and 12). Each of the communication feed paths 332 and 342 may have any desirable construction. For example, each of the feed paths 332 may comprise a conduit which links each nitrous oxide feed port 330 with the nitrous oxide channel 318. Similarly, each of the feed paths 342 may comprise a conduit linking each of the fuel feed ports 340 with an opening in the bottom of the body plate member at a location which communicates with the fuel channel 418.

Figure 5:
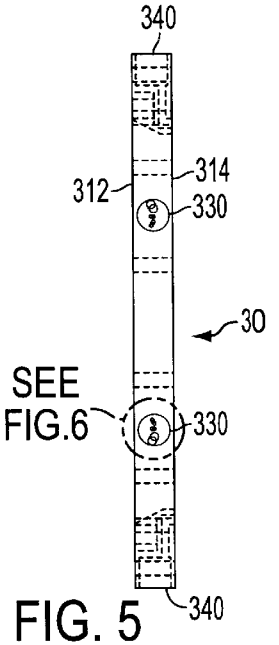
FIG. 5 is side view of the body plate member of FIG. 4.
Figure 6:
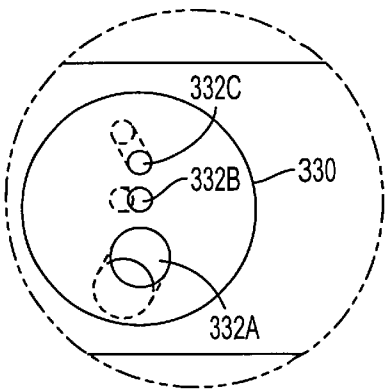
FIG. 6 is a detail view taken from FIG. 5.
Figure 4:
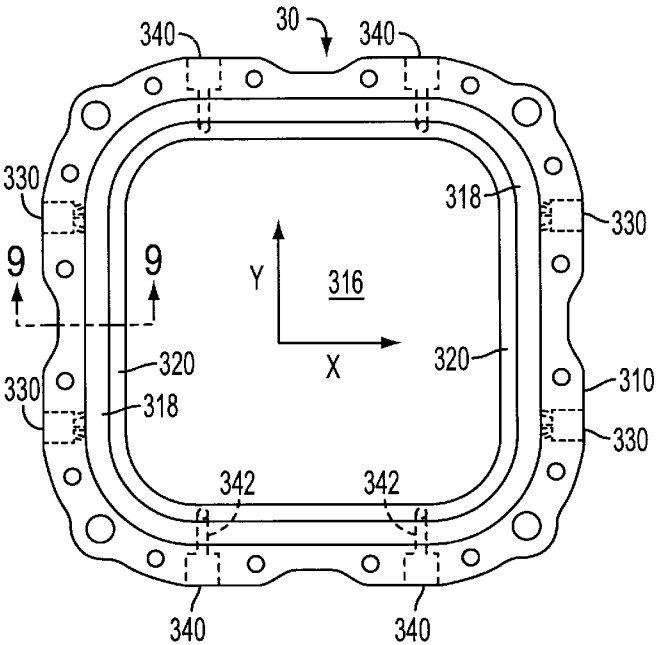
FIG. 4 is top plan view of the body plate member according to the first preferred embodiment of the module.

In one embodiment, shown in FIGS. 4–6, each nitrous oxide feed port 330 is connected with three communication feed paths 332A, 332B and 332C (FIG. 6). The feed paths 332B and 332C have their terminal openings directed towards the middle portion of that segment of the nitrous oxide channel 318 where the nitrous oxide feed port is placed, and these feed paths have a smaller diameter than the feed path 332A. The feed path 332A has its terminal opening directed toward the semi-circular corner of that portion of the nitrous oxide channel 318 where the nitrous oxide feed port is placed (FIGS. 4–6). The semi-circular corner corresponds approximately to the location of a cylinder of the internal combustion engine. In this embodiment, the relative dimensions and orientation of the three communication feed paths in conjunction with the geometry of the fence 213 provide a particularly advantageous and uniform nitrous oxide spray plume around the circumference of the air passage. In one preferred embodiment, the communication feed path 332A has a diameter of 0.110 inches, and each of the communication feed paths 332B and 332C has a diameter of 0.040 inches. As illustrated in FIGS. 4–9, the terminal communication feed paths 332A and 332C are inclined at an angle of 25 degrees in the XZ plane and 30 degrees in the XY plane.

In one embodiment, each of the communication feed paths 342 has a diameter of 0.110 inches and is 0.125 inches deep.

Figure 11B:
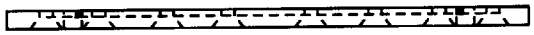
FIG. 11B is a side view of the bottom plate member of FIG. 10.
Figure 10:
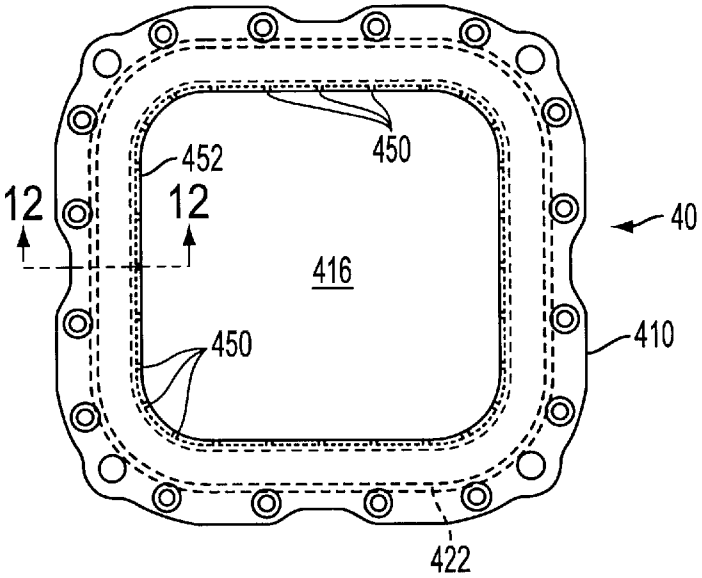
FIG. 10 is a top plan view of the bottom plate member according to the first preferred embodiment of the module.
Figure 11A:
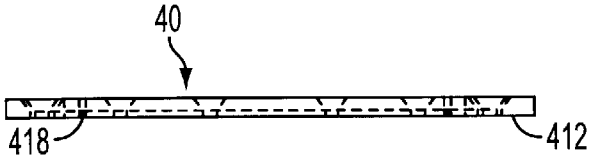
FIG. 11A is a side view of the bottom plate member of FIG. 10.

Referring now to FIGS. 10–12, the bottom plate member 40 is illustrated. The bottom plate member 40 comprises a bottom plate 410 including a top surface 412 which comes into contact with the bottom surface 314 of the body plate member 30. The bottom plate member 40 includes a central portion 416 through which the airstream A flows. A fuel channel 418 is formed in the top surface 412. Fuel F (not illustrated) from fuel feed ports 340 is delivered via communication feed paths 342 into the fuel channel 418. A plurality of spaced radial holes (or discharge ports) 450 are formed in the inner side wall 452 of bottom plate member 40. The fuel F is delivered through radial holes 450 into the central portion 416. A channel 422 is provided in the proximity of the wall 413. A gasket is positioned within channel 422. The gasket positioned in channel 422 serves to contain fuel F within fuel channel 418.

Figure 34:
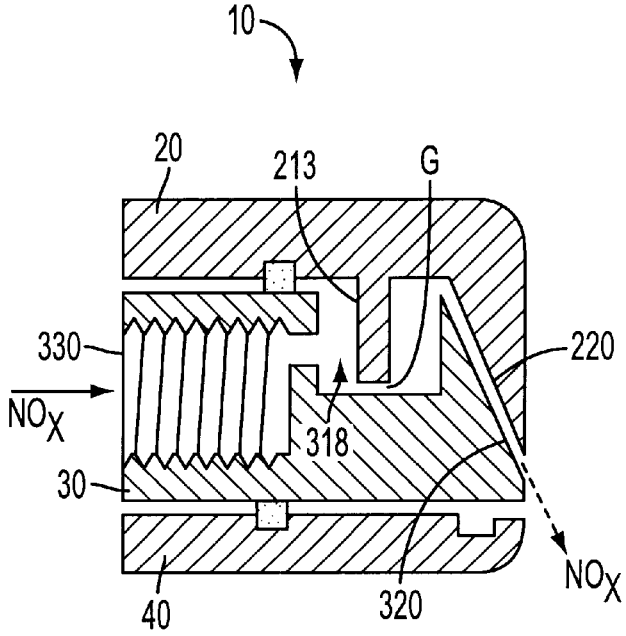
FIG. 34 is a cross sectional view of the module illustrating the features of the nitrous oxide fuel delivery paths according to the preferred embodiments.
Figure 35:
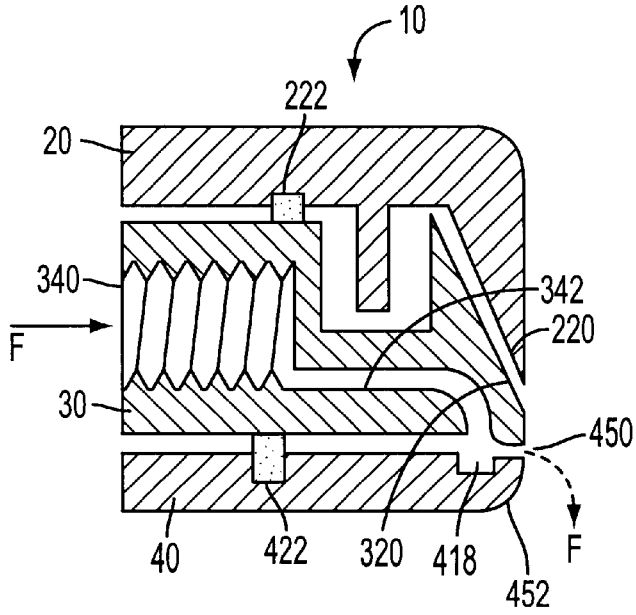
FIG. 35 is a cross sectional view of the module illustrating the features of the fuel delivery paths according to the preferred embodiments.
Figure 38:
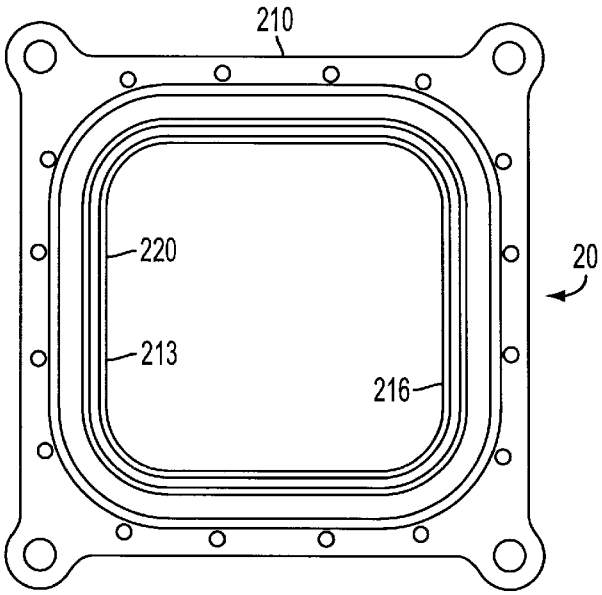
FIG. 38 is a plan view of the bottom of the top plate member of FIG. 36.
Figure 39:
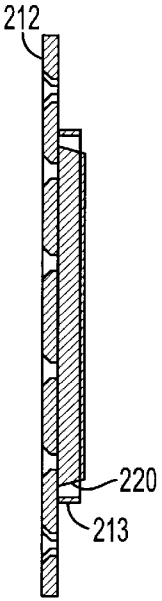
FIG. 39 is a side view of the top plate member of FIG. 36.
Figure 37A:
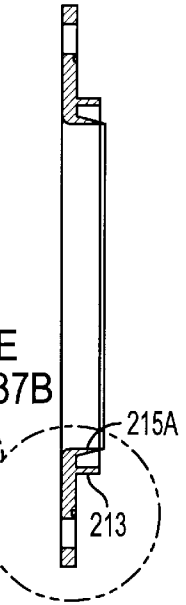
FIG. 37A is a side view of the top plate member of FIG. 36.
Figure 37B:
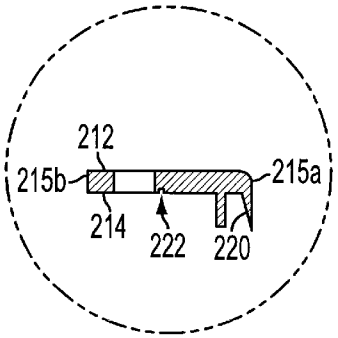
FIG. 37B is a detail view of an area from FIG. 37A.
Figure 36:
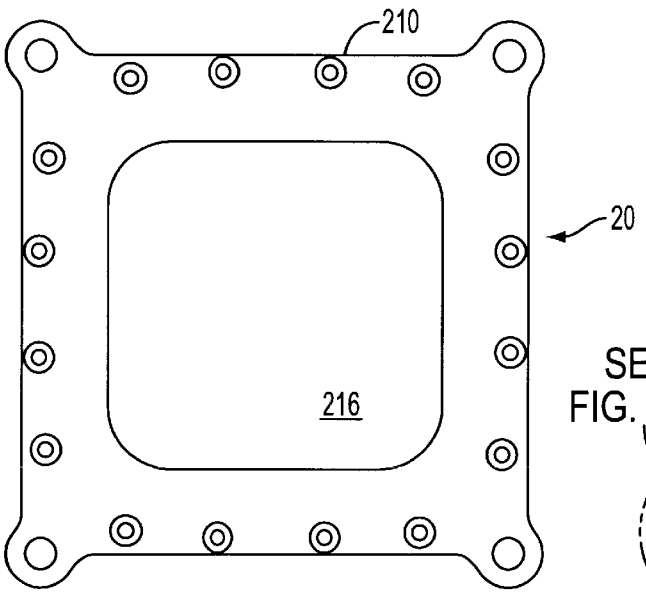
FIG. 36 is a plan view of the top of the top plate member according to a second preferred embodiment of the module.
Figure 41:
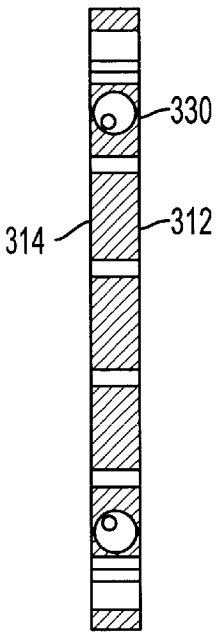
FIG. 41 is a side view of the body plate member of FIG. 40.
Figure 40:
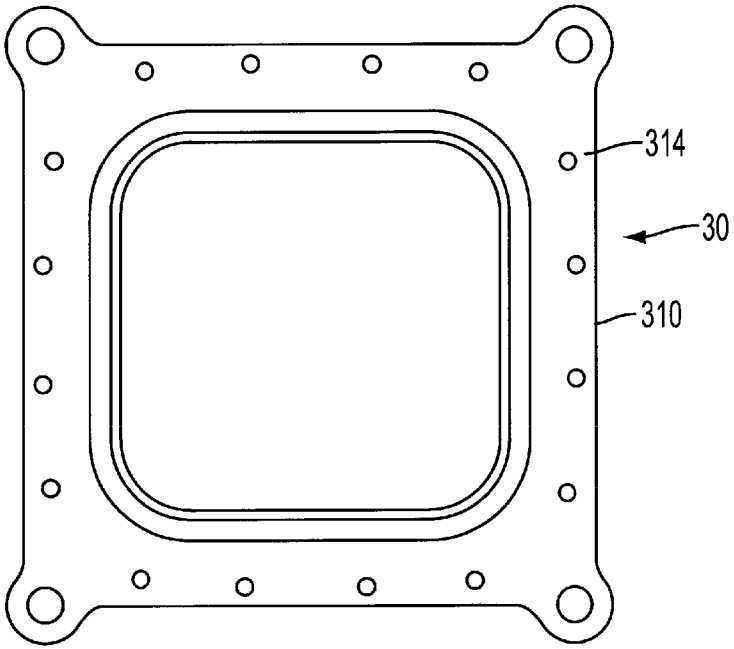
FIG. 40 is a plan view of the bottom of the body plate member according to a second preferred embodiment of the module.
Figure 42:
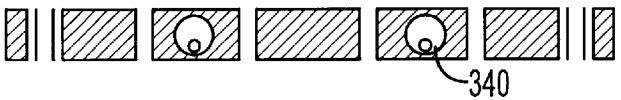
FIG. 42 is a side view of the body plate member of FIG. 40.
Figure 45:
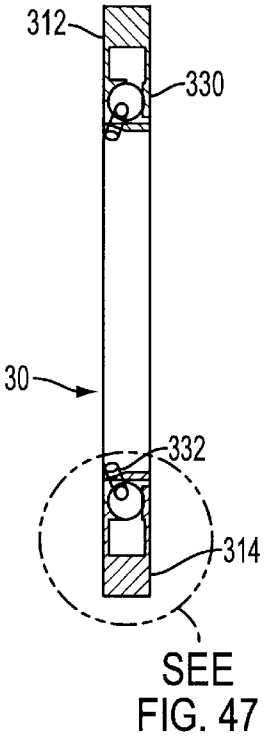
FIG. 45 is a side view of the body plate member of FIG. 43.
Figure 46:
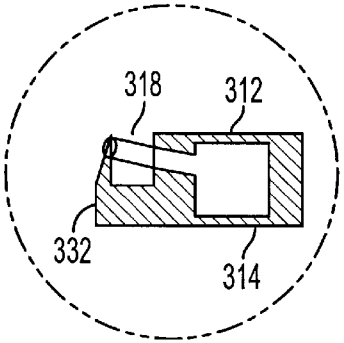
FIG. 46 is a detail view taken from FIG. 44.
Figure 47:
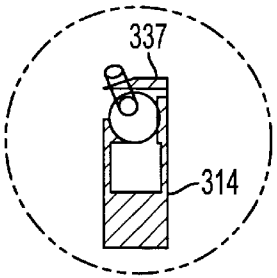
FIG. 47 is a detail view taken from FIG. 45.
Figure 43:
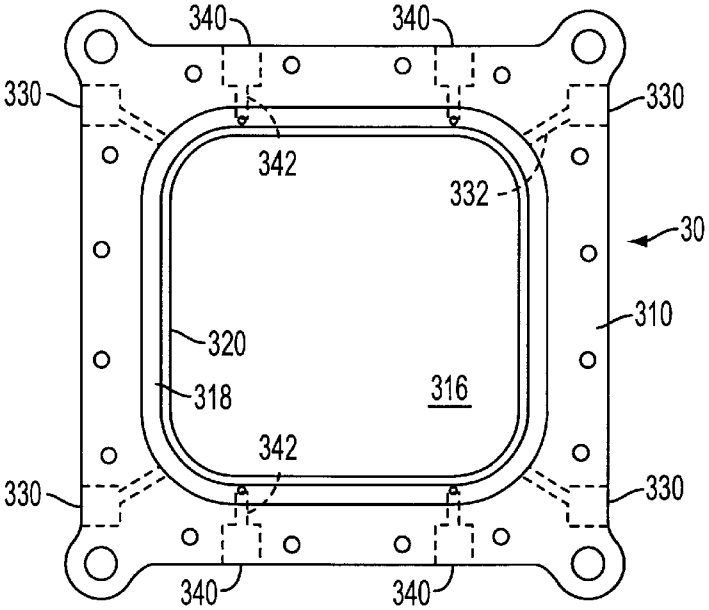
FIG. 43 is a plan view of the top of the body plate member according to a second preferred embodiment of the module.
Figure 44:
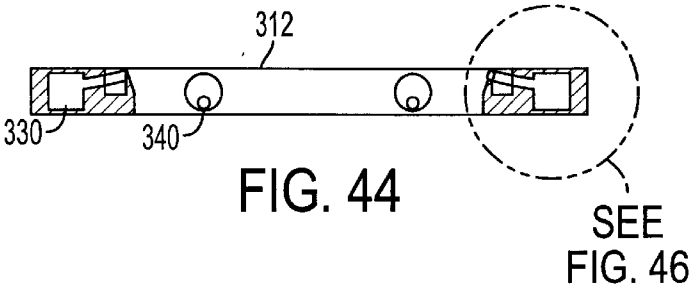
FIG. 44 is a side view of the body plate member of FIG. 43.
Figure 51:
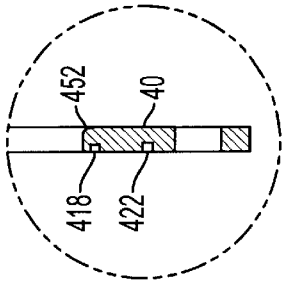
FIG. 51 is a detail view taken from FIG. 49.

Now with reference to FIGS. 34–35, the cooperation of the three principal components, namely, the top plate member 20, the body plate member 30, and the bottom plate member 40 will become apparent. FIGS. 34–35 representatively illustrate cross sections of the assembled module 10. Advantageously, a small gap G (in one embodiment, approximately 4 mils or 0.004 inches) is formed between the distal end of the wall 213 and the bottom of the channel 318. Consequently, the nitrous oxide is caused to follow a tortured path along the wall 213, through the gap G beneath the wall 213, then back up along the wall 213 and back down a very small gap between the mating conical surfaces 220, 320 before being discharged to the airstream A. Without wishing to be bound by any theory of operability, it is believed that this tortured path causes a substantially uniform distribution of the nitrous oxide prior to delivery to the airstream A. Pressure of nitrode oxide in the channel 318 is relatively high (about 900 to about 1,100 psi). When the module is assembled, the mating surfaces 220, 320 form a relatively tight seal with a very small gap between the two mating surfaces 220, 320. That gap is about 4 to about 6 mils (i.e., about 0.004 to about 0.006 inches). Nonetheless, the high pressure of the nitrous oxide forces it to exit the nitrous oxide channel 318 through the very small gap, and be discharged in a substantially uniform manner into the airstream A, upstream from the outlet of the radial holes 450 which discharge fuel into the airstream.

The fuel F, on the other hand, operates under much lower pressure (7–50 psi) than the nitrous oxide. Consequently, the fuel need not be delivered in a tortured path. Instead, as illustrated in FIG. 35, the fuel is delivered into the channel 418. From there, the fuel F enters the airstream A through the plurality of radial holes 450 formed in the inner side wall 452 of the bottom plate member 40.

Figure 52:
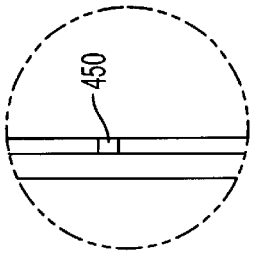
FIG. 52 is a detail view taken from FIG. 48.
Figure 48:
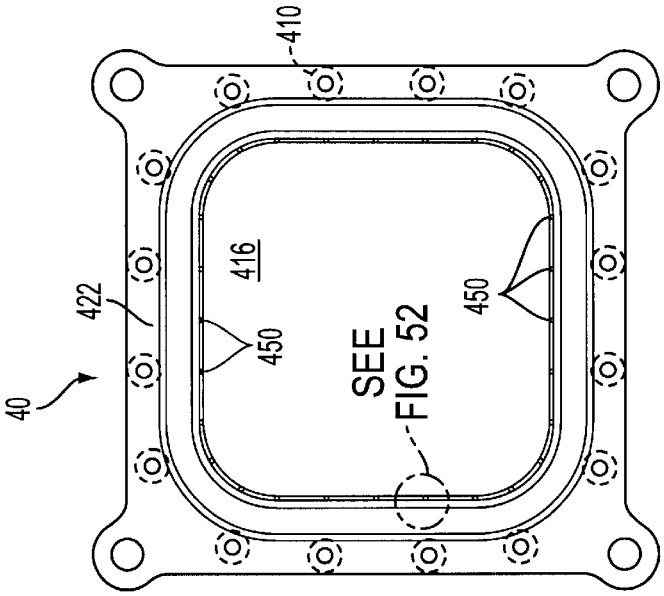
FIG. 48 is a plan view of the bottom plate member according to a second preferred embodiment of the module.

Dimensions of various components of the plate are not critical and may be designed by those skilled in the art for a particular technical application and the combination of the carburetor and manifold. In one embodiment, the depth of the nitrous oxide channel 318 is about 0.280 inches, the fuel channel 418 is 0.070 inches wide and 0.055 inches deep, and the bottom plate member has thirty two (32) radial holes 450 delivering fuel into the airstream A. In another embodiment, such as that shown in FIGS. 48 and 52, the bottom plate member has a series of slots having a width of 0.030 inches and a depth of 0.020 inches.

Figure 50:
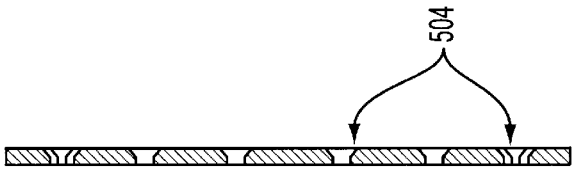
FIG. 50 is a side view of the bottom plate member of FIG. 48 showing details of screw holes for screws which hold the plate together.
Figure 49:
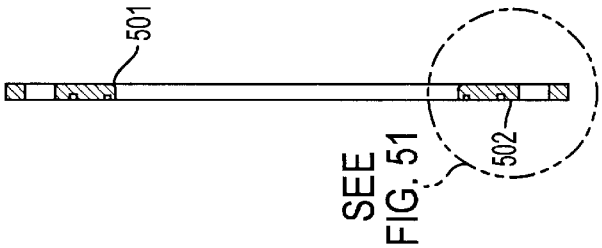
FIG. 49 is a side view of the bottom plate member of FIG. 48 showing details of carburetor bolt clearance and exit radius of the air passage.

FIGS. 13–23 and 36–52 illustrate the features of a second preferred embodiment. FIGS. 24—33 illustrate the features of a third preferred embodiment. For example, in FIG. 49, air passage (exit) 416 of the air passage is shown and its dimensions, such as radius 501 which is 0.063 inches, and carburetor bolt clearance 502 are, also illustrated. In FIG. 50, countersunk holes 504 to hold the plate together are illustrated. FIGS. 36–52 show some alternative details of the second preferred embodiment. The same reference numerals are used in the various drawings to represent the same elements of the module. Since the basic principles of operation and construction remain the same between the various embodiments, one of ordinary skill in the art will readily appreciate the manner of constructing the second and third embodiments by reference to the discussion above.

Nonetheless, some of the differences between the first embodiment, and the second, and the third embodiments are summarized below.

Figure 17:
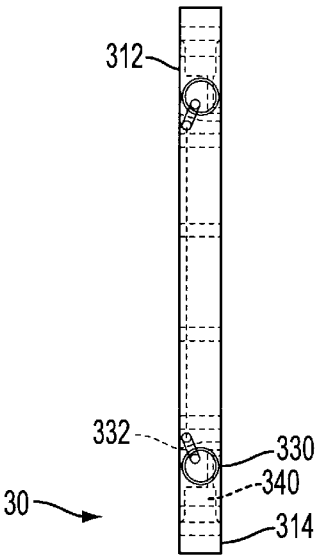
FIG. 17 is a side view of the body plate member of FIG. 16.
Figure 16:
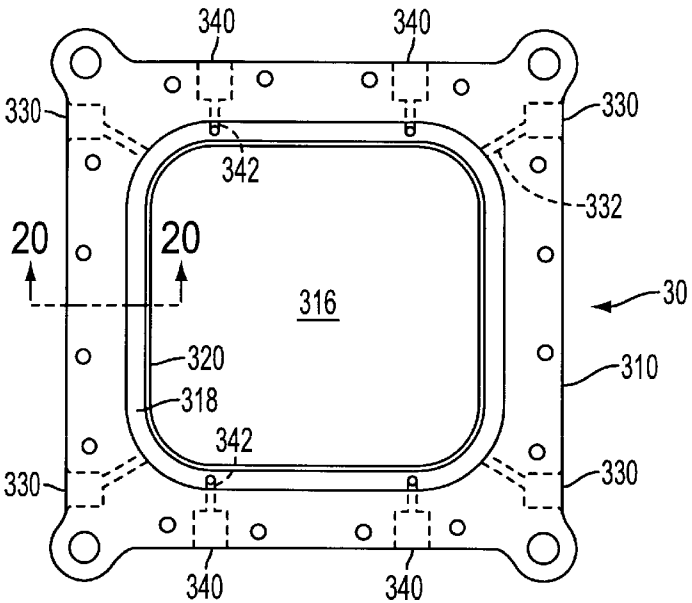
FIG. 16 is a top plan view of the body plate member according to the second preferred embodiment of the module.
Figure 18:
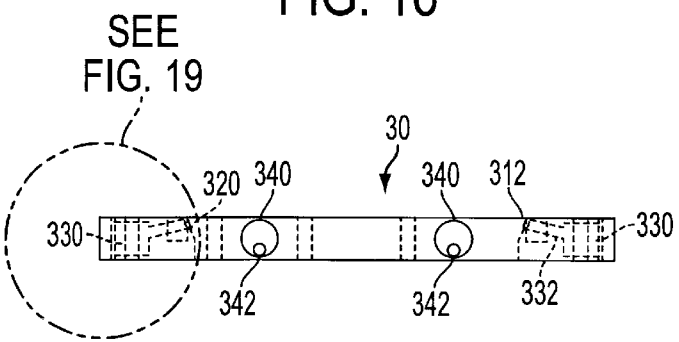
FIG. 18 is a side view of the body plate member according to FIG. 16.
Figure 20:
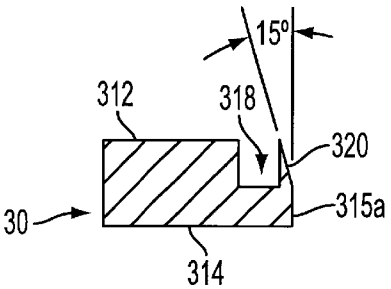
FIG. 20 is a cross sectional view taken along line 20—20 in FIG. 16.
Figure 19:
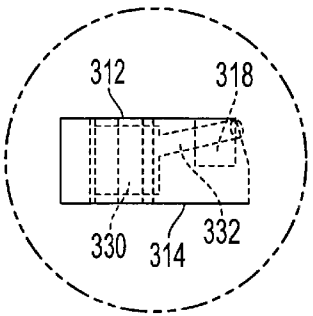
FIG. 19 is a detail view taken from FIG. 18.
Figure 22B:
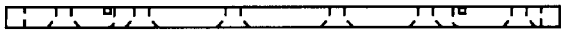
FIG. 22B is a side view of the bottom plate member of FIG. 21.
Figure 21:
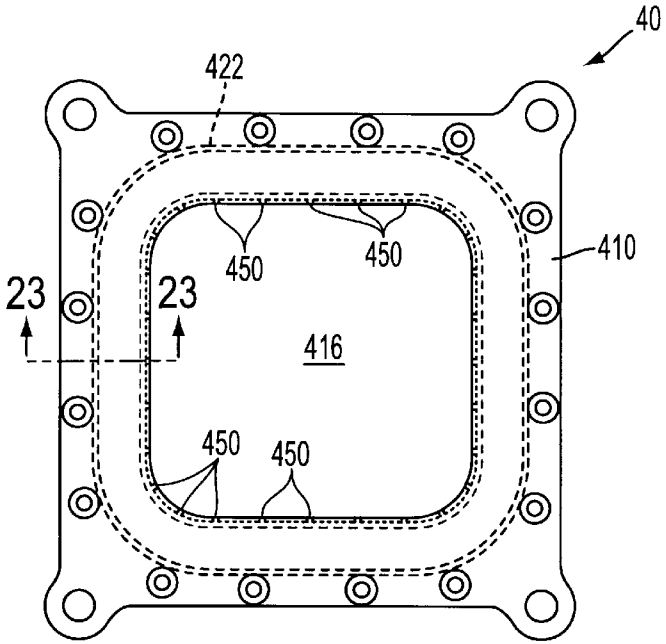
FIG. 21 is a top plan view of the bottom plate member according to the second preferred embodiment of the module.
Figure 22A:
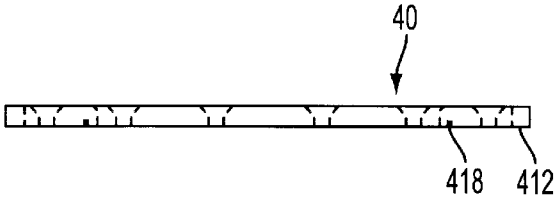
FIG. 22A is a side view of the bottom plate member of FIG. 21.
Figure 23:
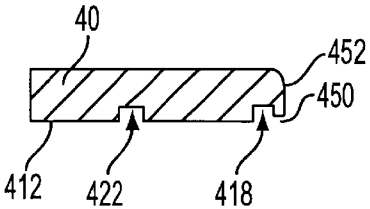
FIG. 23 is a cross sectional view taken along line 23—23 in FIG. 21.
Figure 26:
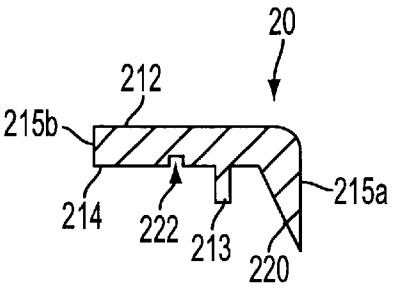
FIG. 26 is a cross sectional view taken along line 26—26 in FIG. 24.
Figure 25B:
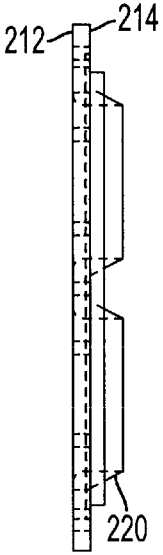
FIG. 25B is a side view of the top plate member of FIG. 24.
Figure 24:
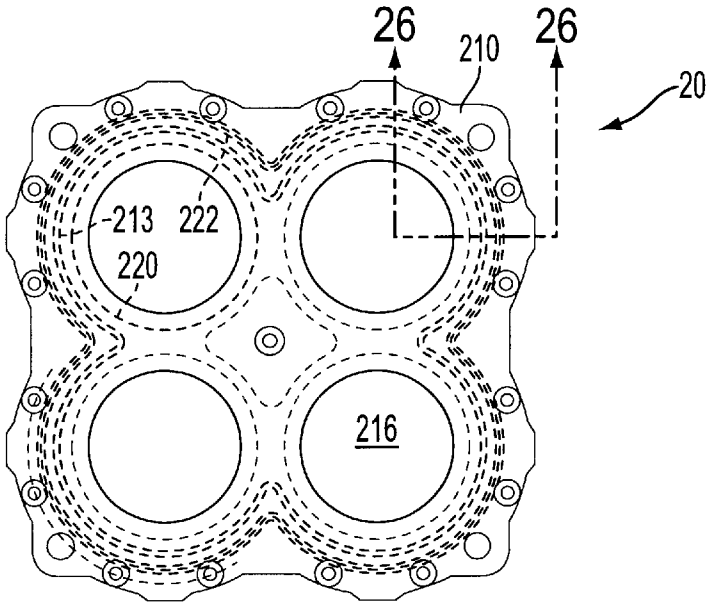
FIG. 24 is a top plan view of the top plate member according to a third preferred embodiment of the module.
Figure 25A:
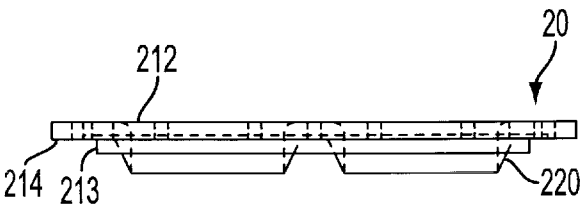
FIG. 25A is a side view of the top plate member of FIG. 24.
Figure 30:
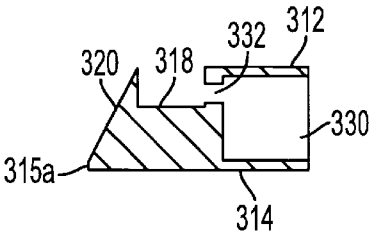
FIG. 30 is a cross sectional view taken along line 30—30 in FIG. 27.

In the second embodiment, the nitrous oxide inlet feed ports 330 are placed in the corners of the body plate member. Each nitrous oxide feed port 330 is connected to a single communication feed path 332 (FIGS. 16, 17, and 18). In one version of the second embodiment, the communication feed path 332 has a diameter of 0.110 inches and the mating conical surfaces 220, 320 have an angle of 15 degrees. In one version of this embodiment, the fence 213 is approximately 0.003" longer along the four substantially straight portions K of the top plate than in the semicircular portions of the top plate. Thus, in this version, the gap G (not shown in FIGS. 13–23) may be approximately two (2) mils along the four substantially straight (linear) portions of the top plate and approximately 4 mils in the semicircular portions of the top plate. In this second embodiment, and all other embodiments, the gap between the conical surfaces 220 and 320 is approximately 0.004—approximately 0.006 (inches), and preferably it is 0.004–0.006 inches.

Figure 29:
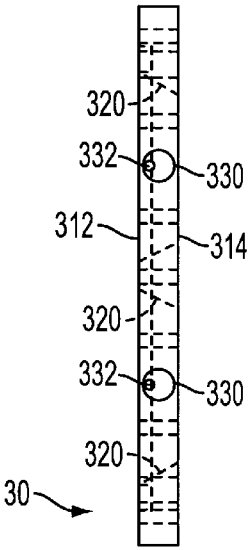
FIG. 29 is a side view of the body plate member according to the FIG. 27.
Figure 27:
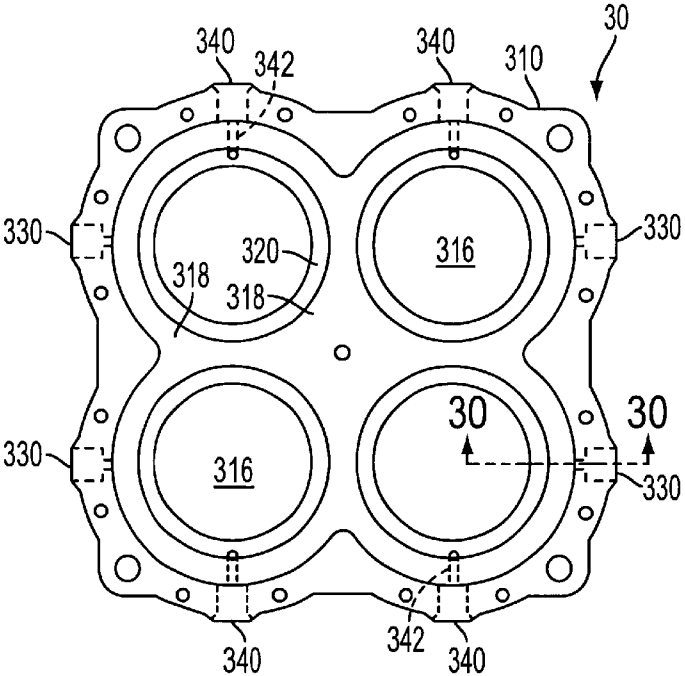
FIG. 27 is top plan view of the body plate member according to the third preferred embodiment of the module.
Figure 28:
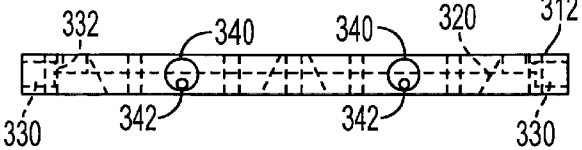
FIG. 28 is a side view of the body plate member of FIG. 27.
Figure 33:
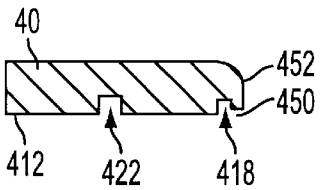
FIG. 33 is a cross sectional view taken along line 33—33 in FIG. 31.
Figure 32B:
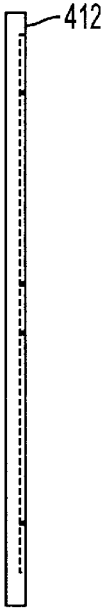
FIG. 32B is a side view of the bottom plate member of FIG. 31.
Figure 31:
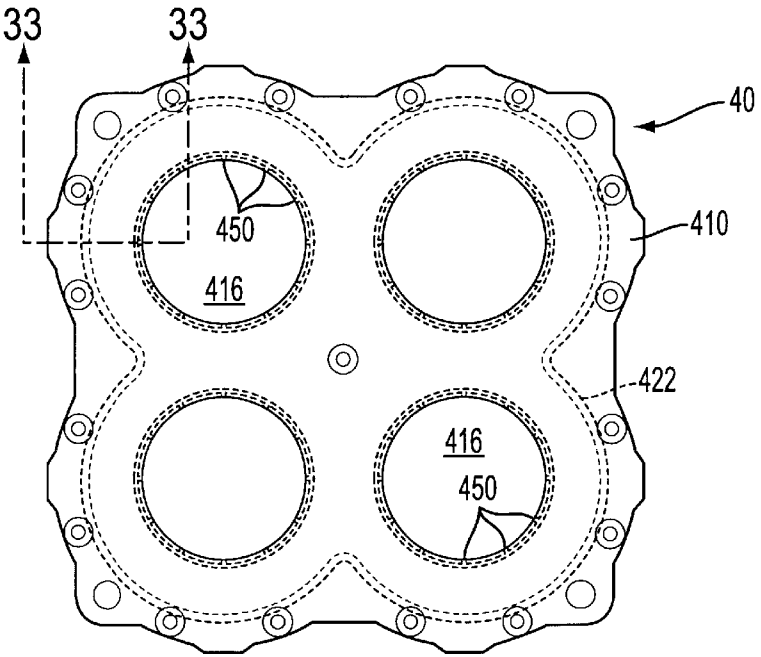
FIG. 31 is a top plan view of the bottom plate member according to the third preferred embodiment of the module.
Figure 32A:
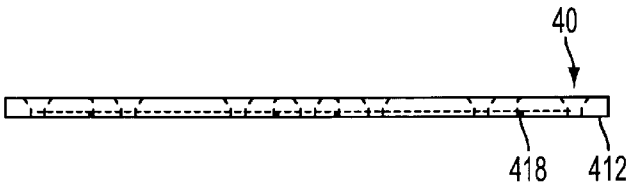
FIG. 32A is a side view of the bottom plate member of FIG. 31.

In the third embodiment, the plate, including a top plate member, a bottom plate member and a body plate member, is subdivided into four separate circular regions, which subdivide the central portion 216 into four separate circular air passages. Each of the four separate, circular air passages delivers the mixture of air, fuel and nitrous oxide into an intake manifold. Each of the nitrous oxide feed ports 330 is connected to a single communication feed path 332 (FIGS. 28 and 29). In one embodiment, the communication feed path 332 has a diameter of 0.110 inches.

In all Figures, any dimensions shown are in inches, unless otherwise indicated.

The invention has been described in connection with the preferred embodiments. This description is illustrative only and does not limit the invention. Many variations and modifications are within the scope of the preferred embodiments without departing from the scope of the invention as defined by the appended claims.

What is claimed is:

1. A fuel supply module for adding fuel and nitrous oxide to an airstream flowing from a carburetor to an intake manifold of an internal combustion engine, comprising:

a plate member for placement between the carburetor and the intake manifold of the internal combustion engine, said plate member defining an air passage therethrough sized and shaped for passing the airstream from the carburetor to the internal combustion engine, said air passage including a central axis extending parallel to the direction of flow of the airstream moving through said air passage;

at least one inlet feed port formed in said plate member for introducing nitrous oxide into said plate member;

at least one inlet feed port formed in said plate member for introducing fuel into said plate member;

a first communication passage formed in said plate member for distributing said nitrous oxide within said plate member;

a second communication passage formed in said plate member for distributing said fuel within said plate member;

at least one first discharge port formed in said plate member for discharging said nitrous oxide into said airstream, said at least one first discharge port causing said nitrous oxide to be discharged substantially evenly around the periphery of the air passage formed in said plate member; and at least one second discharge port formed in said plate member for discharging said fuel into said airstream, said at least one second discharge port causing said fuel to be discharged substantially evenly around the periphery of the air passage formed in said plate member.

2. The fuel supply module according to claim 1, wherein said plate member comprises a top plate member, a bottom plate member and a body plate member formed therebetween, said first communication passage included between said top plate member and said body plate member, and said second communication passage included between said body plate member and said bottom plate member.

3. The fuel supply module according to claim 2, wherein said first communication passage comprises a reservoir extending in a circuitous path within said plate member, so that said first communication passage extends around the air passage.

4. The fuel supply module according to claim 3, wherein said first communication passage comprises at least one nitrous oxide feed port in fluid communication with at least one communication feed path, which is in fluid communication with the reservoir.

5. The fuel supply module according to claim 3, wherein said first communication passage includes a barrier means for segregating said reservoir into an outer reservoir and an inner reservoir.

6. The fuel supply module according to claim 5, wherein aid barrier means comprises a wall extending from said top plate member into said first communication passage.

7. The fuel supply module according to claim 3, further comprising a seal provided between said top plate member and said body plate member at a position outside said reservoir.

8. The fuel supply module according to claim 2, wherein said at least one first discharge port is formed between mating angled surfaces of said top plate member and said body plate member.

9. The fuel supply module according to claim 8, wherein said mating angled surfaces formed between said top plate member and said body plate member provide an annular discharge of the nitrous oxide into said airstream.

10. The fuel supply module according to claim 2, wherein said second communication passage comprises a fuel reservoir formed between said body plate member and said bottom plate member, and further comprising a plurality of said second discharge ports formed substantially evenly around said fuel reservoir and discharging fuel into said airstream at a position downstream from said first discharge port.

11. The fuel supply module according to claim 10, further comprising a seal provided between said bottom plate member at a position outside said fuel reservoir.

12. The fuel supply module according to claim 1, further comprising a plurality of separate airstreams formed through said plate member.

13. The fuel supply module according to claim 12, further comprising a plurality of said first discharge ports for discharging said nitrous oxide and a plurality of said second discharge ports for discharging said fuel, associated with each of said plurality of separate airstreams.

14. An internal combustion engine comprising a fuel supply module for adding fuel and nitrous oxide to an airstream flowing from a carburetor to an intake manifold of the internal combustion engine, comprising:

a plate member for placement between the carburetor and the intake manifold of the internal combustion engine, said plate member defining an air passage therethrough sized and shaped for passing the airstream from the carburetor to the internal combustion engine, said air passage including a central axis extending parallel to the direction of flow of the airstream moving through said air passage;

at least one inlet feed port formed in said plate member for introducing nitrous oxide into said plate member;

at least one inlet feed port formed in said plate member for introducing fuel into said plate member;

a first communication passage formed in said plate member for distributing said nitrous oxide within said plate member;

a second communication passage formed in said plate member for distributing said fuel within said plate member;

at least one first discharge port formed in said plate member for discharging said nitrous oxide into said airstream, said at least one first discharge port causing said nitrous oxide to be discharged substantially evenly around the periphery of the air passage formed in said plate member; and at least one second discharge port formed in said plate member for discharging said fuel into said airstream, said at least one second discharge port causing said fuel to be discharged substantially evenly around the periphery of the air passage formed in said plate member.

15. The internal combustion engine according to claim 14 further comprising a manifold.

16. The internal combustion engine according to claim 14 wherein said plate member comprises a top plate member, a bottom plate member and a body plate member formed therebetween, said first communication passage included between said top plate member and said body plate member, and said second communication passage included between said body plate member and said bottom plate member.

17. The internal combustion engine according to claim 16, wherein said first communication passage comprises a reservoir extending in circuitous path within said plate member, so that said first communication passage extends around the air passage.

18. The internal combustion engine according to claim 17, wherein said first communication passage comprise at least one nitrous oxide feed port in fluid communication with at least one communication feed path, which is in fluid communication with the reservoir.

19. The internal combustion engine according to claim 17, wherein said first communication passage includes a barrier means for segregating said reservoir into an outer reservoir and an inner reservoir.

20. The internal combustion engine according to claim 19, wherein said barrier means comprises a wall extending from said top plate member into said reservoir.

21. The internal combustion engine according to claim 16, wherein said at least one discharge port is formed between mating angled surfaces of said top plate member and said body plate member.

22. The internal combustion engine according to claim 21, wherein said mating angled surfaces formed between said top plate member and said body plate member provide an annular discharge of the nitrous oxide into said airstream.

23. The internal combustion engine according to claim 16, wherein said second communication passage comprises a fuel reservoir formed between said body plate member and said bottom plate member, and further comprising a plurality of said second discharge ports formed substantially evenly around said fuel reservoir and discharging fuel into said airstream at a position downstream from said first discharge port.

24. The internal combustion engine according to claim 16, further comprising a seal provided between said bottom plate member and said body plate member at a position outside said fuel reservoir.

25. The internal combustion engine according to claim 24, further comprising a plurality of separate airstreams formed through said plate member.

26. The internal combustion engine according to claim 25, further comprising a plurality of said first discharge ports for discharging said nitrous oxide and a plurality of said second discharge ports for discharging said fuel, associated with each of said plurality of separate airstreams.

* * * * *